US009725660B2

(12) United States Patent
Gjata et al.

(10) Patent No.: US 9,725,660 B2
(45) Date of Patent: Aug. 8, 2017

(54) OIL/BITUMEN EMULSION SEPARATION

(71) Applicant: Weatherford Technology Holdings, LLC, Houston, TX (US)

(72) Inventors: Aleksander Gjata, Calgary (CA); Tony Yu Hung Ma, Calgary (CA)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 39 days.

(21) Appl. No.: 14/939,073

(22) Filed: Nov. 12, 2015

(65) Prior Publication Data

US 2016/0137929 A1 May 19, 2016

Related U.S. Application Data

(60) Provisional application No. 62/079,023, filed on Nov. 13, 2014.

(51) Int. Cl.
*C10G 33/04* (2006.01)
*C10G 31/10* (2006.01)

(52) U.S. Cl.
CPC ..... *C10G 33/04* (2013.01); *C10G 31/10* (2013.01)

(58) Field of Classification Search
CPC ..... C10G 33/04; C10G 31/10
See application file for complete search history.

(56) References Cited

U.S. PATENT DOCUMENTS 2,674,562 A 4/1954 Elliott
4,405,446 A * 9/1983 Kruyer ..... C10G 1/047 196/46
4,829,045 A * 5/1989 Fransham ..... A01K 1/0155 210/242.4
5,882,506 A 3/1999 Ohsol et al.
8,093,304 B2 1/2012 Varadaraj et al.
2006/0016727 A1* 1/2006 Varadaraj ..... C10G 29/02 208/177
2014/0202927 A1 7/2014 Tao et al.
2014/0322777 A1 10/2014 Clark et al.

OTHER PUBLICATIONS

Kilpatrick et al, The Effects of Inorganic Solid Particles on Water and Crude Oil Emulsion Stability, 2002, American Chemical Society, Ind. Eng. Chem. Res. vol. 41, 3389-3404.*
Canadian Office Action for Application No. 2,911,610 dated Nov. 24, 2016.

* cited by examiner

*Primary Examiner* — Randy Boyer
*Assistant Examiner* — Juan Valencia
(74) *Attorney, Agent, or Firm* — Patterson & Sheridan, LLP

(57) ABSTRACT

In one implementation, a method for recovery of crude oil from a production fluid comprising an oil-water emulsion is provided. The method comprises adding a solid hydrophilic compound to the production fluid to form a production fluid-solid hydrophilic compound mixture. The method further comprises separating the production fluid-solid hydrophilic compound mixture to produce an oil phase containing the heavy crude oil and a water phase containing the solid hydrophilic compound. The production fluid-solid hydrophilic compound mixture may be separated by centrifuging the production fluid-solid hydrophilic compound mixture to produce the oil phase and the water phase. After separation, the oil phase may be analyzed to determine at least one of: oil composition, physical properties, and geochemical analysis. The crude oil comprises at least one of heavy crude oil, bitumen or combinations thereof.

20 Claims, No Drawings

OIL/BITUMEN EMULSION SEPARATION

CROSS-REFERENCE TO RELATED APPLICATIONS

This application claims benefit of U.S. Provisional Patent Application Ser. No. 62/079,023, filed Nov. 13, 2014, which is herein incorporated by reference.

BACKGROUND

Field

Implementations of the present disclosure generally relate to the separation of production fluids into oil and water phases and more particularly to the demulsification of heavy crude oils by centrifuge.

Description of the Related Art

Emulsion is defined as a system in which one liquid is relatively distributed or dispersed, in the form of droplets, in another substantially immiscible liquid. In production and flow assurance, the two commonly encountered emulsion types are water droplets dispersed in the oil phase and termed water-in-oil emulsion (W/O) and if the oil is the dispersed phase, it is termed oil-in-water (O/W) emulsion. In crude oil production from brown fields or heavy oil, there is often production of water-in-oil emulsions.

To properly evaluate the properties of water-in-oil emulsions in a laboratory setting, the water needs to be separated out without changing the composition of the oil. Water-in-oil emulsions are typically separated by centrifuge. A centrifuge puts an object in rotation about a fixed axis, applying a force perpendicular to the axis where the centripetal acceleration causes denser substances to separate out along the radial direction, the bottom of the tube and lighter objects tend to move to the top of the tube. However, in most cases, the oil cannot be cleaned by centrifuge as the contrast of density between the water phase and the oil phase does not exist.

To solve this problem, laboratories have developed combined methods that separate water-in-oil emulsions by centrifuge in combination with additional physical and/or chemical treatment. For example, centrifuging while heating the oil sample, centrifuging in the presence of surfactants, or centrifuging in the presence of various solvents. However, these methods typically compromise the heavy oil sample by changing its composition, changing its physical properties like viscosity and density and removing the light hydrocarbon (e.g., $C_1$-$C_7$ hydrocarbons) portions of the sample. Typically, methods that use centrifugation in combination with heat cause the loss of light hydrocarbons (e.g., $C_1$-$C_7$ hydrocarbons) and change the composition of the oil. Methods that use solvents in combination with centrifugation compromise the composition of the oil sample rendering the sample a non-representative sample. Thus, these methods fail to provide a representative oil sample for analysis of oil composition, physical properties and geochemical properties.

Therefore there is a need for methods that separate water-in-oil emulsions in a laboratory setting without physically or chemically altering the oil phase to produce a representative clean heavy oil sample.

SUMMARY OF THE INVENTION

Implementations of the present disclosure generally relate to the separation of production fluids into oil and water phases and more particularly to the demulsification of crude oils by centrifuge. In one implementation, a method for recovering crude oil from a production fluid comprising an oil-water emulsion, wherein the crude oil comprises at least one of heavy crude oil, bitumen or combinations thereof, is provided. The method comprises adding a solid hydrophilic compound to the production fluid to form a production fluid-solid hydrophilic compound mixture and separating the production fluid-solid hydrophilic compound mixture to produce an oil phase containing the crude oil and a water phase containing the solid hydrophilic compound.

In another implementation, a method for recovering crude oil from a production fluid comprising an oil-water emulsion, wherein the crude oil comprises at least one of heavy crude oil, bitumen or combinations thereof, is provided. The method comprises adding a solid hydrophilic compound to the production fluid to form a production fluid-solid hydrophilic compound mixture, wherein the solid hydrophilic compound is selected from the group consisting of: calcium sulfate ($CaSO_4$), ball clay or combinations thereof and centrifuging the production fluid-solid hydrophilic compound mixture to produce an oil phase containing the crude oil and a water phase containing the solid hydrophilic compound.

In another implementation, a method for recovering crude oil from a production fluid comprising an oil-water emulsion is provided. The method comprises adding a hydrophilic compound to the production fluid to form a production fluid-hydrophilic compound mixture and separating the production fluid-hydrophilic compound mixture to produce an oil phase containing the crude oil and a water phase containing the hydrophilic compound, wherein the crude oil comprises at least one of heavy crude oil, bitumen or combinations thereof.

The features, functions, and advantages that have been discussed can be achieved independently in various implementations or may be combined in yet other implementations, further details of which can be seen with reference to the following description and drawings.

DETAILED DESCRIPTION

The following disclosure describes processes and compositions for the recovery of crude oil from a production fluid comprising an emulsion including both oil and water. Certain details are set forth in the following description to provide a thorough understanding of various implementations of the disclosure. Other details describing well-known methods and systems often associated with the recovery of crude oil form a production fluid and sampling of the crude oil are not set forth in the following disclosure to avoid unnecessarily obscuring the description of the various implementations.

Many of the details, components of the other features described herein are merely illustrative of particular implementations. Accordingly, other implementations can have other details, components, and features without departing from the spirit or scope of the present disclosure. In addition, further implementations of the disclosure can be practiced without several of the details described below.

As used herein, the following terms have the meaning set forth below unless otherwise stated of clear from the context of their use.

When introducing elements of the present disclosure or exemplary aspects or implementation(s) thereof, the articles "a," "an," "the," and "said" are intended to mean that there are one or more elements.

The terms "comprising," "including," and "having" are intended to be inclusive and mean that there may be additional elements other than the listed elements.

The term "American Petroleum Institute gravity" ("API gravity") is a measure of how heavy or light a petroleum liquid is compared to water. If the API gravity of petroleum liquid is greater than 10 degrees, the petroleum liquid is lighter than water and floats on water. If the API gravity of the petroleum liquid is less than 10 degrees, the petroleum liquid is heavier than water and sinks in water. API gravity may be calculated as follows where RD is the relative density of the petroleum liquid:

$$API\ \text{gravity} = \frac{141.5}{RD} - 131.5$$

The term "bitumen" or "extra heavy crude oil" refers to crude oil with an API gravity of less than 10 degrees. "Bitumen" or "extra heavy crude oil" has a dynamic viscosity at reservoir conditions of more than 10,000 centipose (cp). The majority of oil produced from bitumen deposits has an API gravity of less than 10 degrees and a reservoir viscosity of over 10,000 centipose.

The term "ball clay" refers to kaolinitic sedimentary clays, that commonly include 20-80% kaolinite, 10-25% mica, and 6-65% quartz.

The term "heavy crude oil" refers to any liquid petroleum with an API gravity ranging from 10 degrees to about 20 degrees. "Heavy crude oil" has a dynamic viscosity at reservoir conditions between 100 cp and 10,000 cp.

The term "production fluid" refers to the fluid mixture of oil, gas and water in formation fluid that flows to the surface of an oil well from a reservoir.

Production fluids recovered from reservoirs contain a mixture of both hydrocarbons (gas and oil) and water. The mixture of both hydrocarbons (gas and oil) and water is often in the form of an oil-water emulsion. In order to produce a representative clean heavy oil sample it is necessary to separate this mixture into parts prior to sampling without changing the composition of the sample. In most cases the oil cannot be cleaned by centrifuge as the contrast in density between the water phase and oil phase does not exist. To demulsify heavy oil and bitumen, current laboratory methods use heat and/or chemicals (e.g., solvents or surfactants) combined with centrifuging. Both heat and solvents compromise the heavy oil sample by changing the composition and physical properties like viscosity and density as well as losing the light hydrocarbon (e.g., $C_1$-$C_7$ hydrocarbons) and sulfur component portions of the sample. In some implementations described herein, the demulsification of oil and bitumen is achieved without the application of heat or the addition of solvents and/or surfactants. In some implementations, demulsification of oil and bitumen is achieved through the addition of a solid hydrophilic compound. Not to be bound by theory but it is believed that the solid hydrophilic compound induces an electrical charge which starts the coalescence of the polar water molecules and the initiation of the aggregation process. It has been found by the inventors that the solid hydrophilic compounds can separate the water from oil even in static conditions. The solid hydrophilic compounds are less than 1% soluble in water and have a neutral pH and thus no chemical reaction occurs with the production fluid.

In some implementations described herein, a one-step demulsification method that may be performed in less than thirty minutes of centrifuging is provided. The methods described herein have removed basic sediments and water (BS&W) below 2% (e.g., below 0.5%) at 40 degrees Celsius or below (e.g., 15 to 20 degrees Celsius) for oils below eight API, leaving intact the original oil composition providing a representative oil sample. Using traditional methods of centrifuging, heavy oil below 8 API cannot be cleaned even after several rounds of centrifuging.

In some implementations, hydrophilic minerals are added into the emulsion of the production fluid at ambient temperature or below. In static conditions the hydrophilic solid particles can separate water phase from oil phase without centrifuging. The testing of the solid particles was successfully performed on different heavy oils and bitumen from Canada and overseas. Results were excellent, cleaning all of the samples with BS&W below 2% (e.g., below 1.5%) at ambient temperature or lower. In some implementations, the hydrophilic solid particles are less than 1% soluble in water and have a neutral pH. Not to be bound by theory but it is believed that no chemical interaction was occurring and the demulsification was based on high electrostatic potential and the attraction of the polar water molecules.

In one implementation, a method for recovery of heavy crude oil from a production fluid comprising an oil-water emulsion is provided. The method comprises adding a solid hydrophilic compound to the production fluid to form a production fluid-solid hydrophilic compound mixture. The method further comprises separating the production fluid-solid hydrophilic compound mixture to produce an oil phase containing the heavy crude oil and a water phase containing the solid hydrophilic compound. The production fluid-solid hydrophilic compound mixture may be separated by centrifuging the production fluid-solid hydrophilic compound mixture to produce the oil phase and the water phase. After separation, the oil phase may be analyzed to determine at least one of: oil composition, physical properties, and geochemical analysis (e.g., Saturate, aromatic, resin and asphaltenes (SARA) analysis, GC-MS/MS).

In some implementations, the solid hydrophilic compound has a solubility of less than 1% in water and has a neutral pH. In some implementations, the solid hydrophilic compound is selected from the group consisting of: ball clay, $CaSO_4$, and combinations thereof.

In some implementations, $CaSO_4$ may be in the form of γ-anhydrite, hemihydrate ($CaSO_4.\sim0.5H_2O$), dihydrate ($CaSO_4.2H_2O$), β-anydrite, or combinations thereof.

In some implementations, ball clay includes 20-80% kaolinite ($Al_2Si_2O_5(OH)_4$), 10-25% mica, and 6-65% quartz ($SiO_2$). In some implementations, the ball clay may include at least one of: quartz, kaolinite, potassium feldspar ($KAlSi_3O_8$), sodium feldspar ($NaAlSi_3O_8$), siderite ($FeCO_3$), anatase ($TiO_2$), pyrite ($FeS_2$), illite ($(K,H_3O)Al_2Si_3AlO_{10}(OH)_2$), chlorite ($(Mg,Fe,Al)_6(Si,Al)_4O_{10}(OH)_8$, smecite or combinations thereof. In some implementations, the ball clay may include at least one of: quartz (61.5%), kaolinite (28.3%), potassium feldspar (2.5%), sodium feldspar (1.5%), siderite (0.4%), anatase (2.6%), pyrite (0.7%), illite (1.7%), and chlorite (0.8%).

In some implementations, the solid hydrophilic compound may have an average particle diameter from about 0.01 micrometers to about 10 micrometers (e.g., from about 1 micrometer to about 5 micrometers; from about 1 micrometer to about 3 micrometers).

The solid hydrophilic compound may be added to the production fluid in an effective amount for separating the oil-water emulsion of the production fluid into a water phase and an oil phase. The solid hydrophilic compound may be added to the production fluid in an amount greater than about 5% by weight (e.g., greater than about 10% by weight; greater than about 15% by weight; greater than about 20% by weight; greater than about 25% by weight; greater than about 30% by weight; greater than about 35% by weight), based on the total weight of the production fluid. The solid hydrophilic compound may be added to the production fluid in an amount less than about 40% by weight (e.g., less than about 35% by weight; less than about 30% by weight; less than about 25% by weight; less than about 20% by weight; less than about 15% by weight; less than about 10% by weight), based on the total weight of the production fluid. The solid hydrophilic compound may be added to the production fluid in an amount between about 5% by weight and about 40% by weight (e.g., between about 10% by weight and about 30% by weight; between about 15% by weight and about 25% by weight; between about 10% by weight and about 22% by weight) based on the total weight of the production fluid.

In some implementations, the amount of solid hydrophilic compound added to the production fluid is based on the API gravity of the crude oil present in the production fluid. For example, if the crude oil has an API gravity between 5 and 8 degrees, the solid hydrophilic compound may be added to the production fluid in an amount between about 15% by weight and about 25% by weight based on the total weight of crude oil in the production fluid. In another example, if the crude oil has an API gravity between 8 and 12 degrees, the solid hydrophilic compound may be added to the production fluid in an amount between about 10% by weight and about 22% by weight based on the total weight of crude oil in the production fluid.

In some implementations, the solid hydrophilic compound is mixed into the production fluid to homogenize the distribution of the solid hydrophilic compound throughout the production fluid. The mixing may occur by an active process, such as stirring or vortex, or the mixing may occur passively, such as by the addition of the solid hydrophilic compound to the production fluid. After mixing, the production fluid-solid hydrophilic compound mixture may be allowed to sit for a period of time.

After mixing, the production fluid-solid hydrophilic compound mixture may be subjected to a separation process. Exemplary separation processes include, but are not limited to centrifugation, filtering, decanting or combinations thereof. In some implementations, the mixture is exposed to a centrifugation process to separate the oil phase and the water phase of the production fluid-solid hydrophilic compound mixture.

The separation process may be performed without heating the production fluid-solid hydrophilic compound mixture. The production fluid-solid hydrophilic compound mixture may be at ambient temperature (e.g., 35 degrees Celsius) or below (e.g., less than 35 degrees Celsius; less than 30 degrees Celsius; less than 25 degrees Celsius; less than 20 degrees Celsius) during the separation process. The production fluid-solid hydrophilic compound mixture may be at a temperature between 20 degrees Celsius to 35 degrees Celsius (e.g., 15 degrees Celsius to 30 degrees Celsius; 20 degrees Celsius to 25 degrees Celsius; 18 degrees Celsius to 25 degrees Celsius) during the separation process.

The production fluid-solid hydrophilic compound mixture to be separated may also stay for a period of time in the separation equipment. For example, the production fluid-solid hydrophilic compound mixture may have a residence time in the separation equipment of at least about 20 minutes (e.g., at least about 30 minutes, at least about 1 hour, at least about 2 hours, at least about 3 hours, at least about 4 hours, at least about 5 hours, at least about 6 hours, at least about 7 hours, at least about 8 hours, at least about 9 hours, at least about 10 hours, at least about 12 hours; at least about 15 hours, or at least about 24 hours). The production fluid-solid hydrophilic compound mixture may have a residence time in the separation equipment between 20 minutes and 48 hours (e.g., between 7 hours and 15 hours; between 8 hours and 12 hours; between 10 hours and 11 hours).

Depending on the centrifuge configuration and size, operating speeds can vary between 500 to 14,000 rpm (e.g., from about 5,000 to about 13,000 rpm; from about 10,000 to about 12,000 rpm). Many centrifuge configurations form separation of oil and water phases are known in the art.

The time for operation of the centrifuge is dependent upon, among other things, the configuration, size, and operating speeds of the centrifuge, the characteristics of the production fluid to be separated, and the amount of solid hydrophilic compound added to the production fluid. In some implementations, the centrifuge may be operated for a time period of 2 hours or less (e.g., 90 minutes or less, 60 minutes or less, 45 minutes or less, 30 minutes or less, or 20 minutes or less).

After separation of the production fluid, an oil phase containing the crude oil and a water phase containing the solid hydrophilic compound and sediment are present. The water phase containing the hydrophilic compound and sediment is typically on the bottom. After separation, the oil phase may have less than 2% by volume basic sediment and water (BS&W) (e.g. less than 1.8% by volume BS&W; less than 1.5% by volume BS&W; less than 1.2% by volume BS&W; less than 1.2% by volume BS&W; or less than 0.5% by volume BS&W).

In some implementations, after the separation process, the oil phase may be analyzed to determine physical and/or chemical characteristics of the oil phase.

EXAMPLES

Objects and advantages of the implementations described herein are further illustrated by the following examples. The particular materials and amounts thereof, as well as other conditions and details, recited in these examples should not be used to limit the implementations described herein. The examples were performed with a Sorvall™ RC 6 Plus Centrifuge, commercially available from Thermo SCIENTIFIC with a maximum speed of 14,000 rpm.

BS&W content was determined by taking a small aliquot of the sample and adding a known amount of a strong solvent (e.g., toluene) to help demulsify and separate the water and solids from the oil phase. After, the volume of the BS&W was calculated using known techniques. The examples were performed without the addition of surfactants, solvents or heat.

A description of the raw materials used in the examples is as follows:

Ball Clay A kaolinitic sedimentary clay having an average particle diameter from about 1 to about 3 micrometers.

Calcium Sulfate ($CaSO_4$) Calcium sulfate, anhydrite, having an average particle diameter from about 0.01 to about 3 micrometers commercially available from Fisher Scientific.

Example 1

Use of $CaSO_4$ for Oils in the Range of 5.1 to 8 API

Approximately 15 to 25 wt. % of $CaSO_4$ based on the total wt. % of the emulsified heavy oil sample were added to 1 kilogram of emulsified heavy oil having an API of 5.1 to 8. The solid hydrophilic particles were mixed in the emulsified heavy oil for approximately five minutes to homogenize the solids distribution. The mixture-emulsion was allowed to sit for approximately 8 to 12 hours before centrifuging. All 6 cups of the centrifuge were filled with 160 cc of the mixture-emulsion. The centrifuge was run at about 12,000 rpm for approximately 40 minutes at 20 degrees Celsius. The centrifuge was stopped and the BS&W were measured to verify the water and solids content. The results are reported in Table I.

TABLE I

Laboratory Data for Oils in the range 5.1 API to 8 API
Concentration of $CaSO_4$ vs. BS&W (Water and Solids Content)
To bring the BS&W below 2% at the first Centrifuging Attempt.
Temperature 20 degrees Celsius

| $CaSO_4$ wt % | Emulsified Water Content BS&W | Oil API | Field | BS&W after Centrifuging % |
|---|---|---|---|---|
| 15 | 15 | 8 | Patos-Marinza | <1 |
| 16 | 16 | 8 | Driza 1 | <1.2 |
| 18 | 20 | 7 | Driza 2 | <1.5 |
| 22 | 28 | 6 | Driza 3 | <1.5 |
| 24 | 35 | 5.2 | Gorani | <1.8 |
| 25 | 42 | 5.5 | Christina-Lake | <1.8 |
| 25 | 45 | 5.1 | Mc.Murray | <2 |

Example 2

Use of Ball Clay for Oils in the Range of 5.1 to 8 API

Approximately 15 to 25 wt. % of ball clay based on the total wt. % of the emulsified heavy oil sample were added to 1 kilogram of the emulsified heavy oil sample having an API of 5.1 to 8. The solid hydrophilic particles were mixed in the emulsified heavy oil for approximately five minutes to homogenize the solids distribution. The mixture-emulsion was allowed to sit for approximately 8 to 12 hours before centrifuging. All 6 cups of the centrifuge were filled with 160 cc of the mixture-emulsion. The centrifuge was run at about 12,000 rpm for approximately 40 minutes at 20 degrees Celsius. The centrifuge was stopped and the BS&W were measured to verify the water and solids content. The results are reported in Table II.

TABLE II

Laboratory Data for Oils in the range 5.1 API to 8 API
Concentration of Ball Clay vs. BS&W (Water and Solids Content)
To bring the BS&W below 2% at the first Centrifuging Attempt.
Temperature 20 degrees Celsius

| Ball Clay wt % | Emulsified Water Content BS&W | Oil API | Field | BS&W after Centrifuging % |
|---|---|---|---|---|
| 15 | 15 | 8 | Patos-Marinza | <1 |
| 16 | 16 | 8 | Driza 1 | <1.4 |
| 20 | 20 | 7 | Driza 2 | <1.5 |
| 24 | 28 | 6 | Driza 3 | <1.6 |
| 25 | 35 | 5.2 | Gorani | <1.8 |
| 25 | 42 | 5.5 | Christina-Lake | <2.0 |
| 25 | 45 | 5.1 | Mc.Murray | <2.0 |

Example 3

Use of $CaSO_4$ for Oils in the Range of 8 to 12 API

Approximately 10 to 22 wt. % of $CaSO_4$ based on the total wt. % of the emulsified heavy oil sample were added to 1 kilogram of the emulsified heavy oil sample having an API of 8 to 12. The solid hydrophilic particles were mixed in the emulsified heavy oil for approximately five minutes to homogenize the solids distribution. The mixture-emulsion was allowed to sit for approximately 8 to 12 hours before centrifuging. All 6 cups of the centrifuge were filled with 160 cc of the mixture-emulsion. The centrifuge was run at about 12,000 rpm for approximately 40 minutes at 20 degrees Celsius. The centrifuge was stopped and the BS&W were measured to verify the water and solids content. The results are reported in Table III.

TABLE III

Laboratory Data for Oils in the range 8 API to 12 API
Concentration of CaSO4 vs. BS&W (Water and Solids Content)
To bring the BS&W below 2% at the first Centrifuging Attempt.
Temperature 20 degrees Celsius

| $CaSO_4$ wt % | Emulsified water Content BS&W | Oil API | Field | BS&W after Centrifuging % |
|---|---|---|---|---|
| 10 | 18 | 12 | Driza well 5190 | <1 |
| 12 | 20 | 11 | Driza well 5358 | <1.2 |
| 15 | 22 | 10.5 | Encana Oil | <1.5 |
| 18 | 25 | 10 | CNRL Oil | <1.5 |
| 20 | 26 | 8.8 | Suncor Oil | <1.8 |
| 22 | 30 | 8.2 | Cenovus Oil | <1.8 |
| 22 | 40 | 8 | Husky Oil | <2.0 |

Example 4

Use of Ball Clay for Oils in the Range of 8 to 12 API

Approximately 10 to 22 wt. % of Ball clay based on the total wt. % of the emulsified heavy oil sample were added to 1 kilogram of the emulsified heavy oil sample having an API of 8 to 12. The solid hydrophilic particles were mixed in the emulsified heavy oil for approximately five minutes to homogenize the solids distribution. The mixture-emulsion was allowed to sit for approximately 8 to 12 hours before centrifuging. All 6 cups of the centrifuge were filled with 160 cc of the mixture-emulsion. The centrifuge was run at about 12,000 rpm for approximately 40 minutes at 20 degrees Celsius. The centrifuge was stopped and the BS&W were measured to verify the water and solids content. The results are reported in Table IV.

TABLE IV

Laboratory Data for Oils in the range 8 API to 12 API
Concentration of Ball Clay vs. BS&W (Water and Solids Content)
To bring the BS&W below 2% at the first Centrifuging Attempt.
Temperature 20 deg C.

| Ball Clay wt % | Emulsified water Content BS&W | Oil API | Field | BS&W after Centrifuging % |
|---|---|---|---|---|
| 10 | 18 | 12 | Driza well 5190 | <1 |
| 14 | 20 | 11 | Driza well 5358 | <1.5 |
| 18 | 22 | 10.5 | Encana Oil | <1.5 |

TABLE IV-continued

Laboratory Data for Oils in the range 8 API to 12 API
Concentration of Ball Clay vs. BS&W (Water and Solids Content)
To bring the BS&W below 2% at the first Centrifuging Attempt.
Temperature 20 deg C.

| Ball Clay wt % | Emulsified water Content BS&W | Oil API | Field | BS&W after Centrifuging % |
|---|---|---|---|---|
| 22 | 25 | 10 | CNRL Oil | <1.5 |
| 22 | 26 | 8.8 | Suncor Oil | <2 |
| 22 | 30 | 8.2 | Cenovus Oil | <2.0 |
| 22 | 40 | 8 | Husky Oil | <2.0 |

Example 5

TABLE V

| | | | | Demulsification without Hydrophilic Mineral | | Demulsification with Hydrophilic Mineral | |
|---|---|---|---|---|---|---|---|
| Heavy Oil I.D. | Well I.D. | Oil API | Initial BS&W | Centrifuge Spin Time (hours) | Demulgated Oil BS&W | Centrifuge Spin Time (hours) | Demulgated Oil BS&W |
| Driza 1 | 5091 | | 40% | 4 | 5.0% | <1 | 1.0% |
| Driza 1 | 5093 | 7.1 | 35% | 5 | 6.5% | <1 | 1.5% |
| Driza 1 | 5121 | 6.0 | 34% | 5 | 10.0% | <1 | 1.5% |
| Driza 1 | 5128 | 6.8 | 30% | 5 | 7.0% | <1 | 1.2% |
| Driza 1 | 5135 | 6.3 | 36% | 5 | 8.0% | <1 | 1.5% |
| Driza 1 | 5154 | 6.2 | 34% | 5 | 12.0% | <1 | 2.0% |
| Cristina Lake | N/A | 7.6 | 35% | 5 | 10.0% | <1 | 1.5% |
| Statoil | N/A | 8.2 | 34% | 5 | 6.5% | <1 | 1.8% |
| McMurray | N/A | 8.0 | 30% | 5 | 6.5% | <1 | 1.5% |
| Suncor | N/A | 7.8 | 28% | 5 | 6.5% | <1 | 2.0% |

Table V depicts the demulsification results for samples of heavy crude oil treated according to implementations described herein verses the demulsification results for samples of heavy crude oil that were untreated. Both the demulsification without hydrophilic minerals and the demulsification with hydrophilic mineral were performed without the addition of surfactants, solvents or heat. As depicted in Table V, the heavy oil samples treated according to implementations described herein achieved significant improvements in BS&W in a shorter time period when compared with the untreated samples.

While the foregoing is directed to implementations of the present disclosure, other and further implementations of the invention may be devised without departing from the basic scope thereof, and the scope thereof is determined by the claims that follow.

The invention claimed is:

1. A method for recovering crude oil from a production fluid comprising an oil-water emulsion, the method comprising:

adding a solid hydrophilic compound to the production fluid to form a production fluid-solid hydrophilic compound mixture; and separating the production fluid-solid hydrophilic compound mixture to produce an oil phase containing the crude oil and a water phase containing the solid hydrophilic compound, wherein the crude oil comprises at least one of heavy crude oil, bitumen and combinations thereof.

2. The method of claim 1, wherein the solid hydrophilic compound is selected from the group consisting of calcium sulfate ($CaSO_4$), ball clay, and combinations thereof.

3. The method of claim 1, wherein separating the production fluid-solid hydrophilic compound mixture comprises centrifuging the production fluid-solid hydrophilic compound mixture to produce the oil phase containing the crude oil and the water phase containing the solid hydrophilic compound.

4. The method of claim 1, wherein the separated oil phase has a basic sediment and water (BS&W) content of less than 2% by volume.

5. The method of claim 1, further comprising mixing the solid hydrophilic compound and the production fluid prior to separating the production fluid-solid hydrophilic compound mixture.

6. The method of claim 1, wherein separating the production fluid-solid hydrophilic compound mixture is performed at a temperature of 40 degrees Celsius or less.

7. The method of claim 6, wherein separating the production fluid-solid hydrophilic compound mixture is performed at a temperature of from 20 degrees Celsius to 35 degrees Celsius.

8. The method of claim 1, wherein the solid hydrophilic compound is added to the production fluid in an amount from about 10 to about 30 percent by weight based on the total weight of the production fluid.

9. The method of claim 8, wherein the solid hydrophilic compound is added to the production fluid in an amount from about 15 to about 25 percent by weight based on the total weight of the production fluid.

10. The method of claim 8, wherein the solid hydrophilic compound is added to the production fluid in an amount from about 10 to about 22 percent by weight based on the total weight of the production fluid.

11. The method of claim 1, wherein the crude oil has an API gravity from 5 to 12 degrees.

12. The method of claim 1, wherein the crude oil has an API gravity from 8 to 12 degrees.

13. The method of claim 1, further comprising:

analyzing the oil phase to determine at least one of: oil composition, physical properties, and geochemical properties.

14. The method of claim 3, wherein centrifuging the production fluid-solid hydrophilic compound mixture to produce the oil phase containing the crude oil and the water phase containing the solid hydrophilic compound comprises operating a centrifuge at 10,000 to 12,000 rpm for a period of 45 minutes or less.

15. A method for recovering crude oil from a production fluid comprising an oil-water emulsion, the method comprising:

adding a solid hydrophilic compound to the production fluid to form a production fluid-solid hydrophilic compound mixture, wherein the solid hydrophilic compound is selected from the group consisting of: calcium sulfate ($CaSO_4$), ball clay, and combinations thereof; and centrifuging the production fluid-solid hydrophilic compound mixture to produce an oil phase containing the crude oil and a water phase containing the solid hydrophilic compound, wherein the crude oil comprises at least one of heavy crude oil, bitumen and combinations thereof.

16. The method of claim 15, further comprising analyzing the oil phase to determine at least one of: oil composition, physical properties, and geochemical properties.

17. The method of claim 15, wherein the crude oil has an API gravity from 5.1 to 8 degrees and the solid hydrophilic compound is added to the production fluid in an amount from about 15 to about 25 percent by weight based on the total weight of the production fluid.

18. The method of claim 15, wherein the crude oil has an API gravity from 8 to 12 degrees and the solid hydrophilic compound is added to the production fluid in an amount from about 10 to about 22 percent by weight based on the total weight of the production fluid.

19. The method of claim 15, wherein centrifuging the production fluid-solid hydrophilic compound mixture to produce the oil phase containing the crude oil and the water phase containing the solid hydrophilic compound comprises operating a centrifuge at 10,000 to 12,000 rpm for a period of less than 30 minutes.

20. The method of claim 15, wherein the crude oil comprises bitumen.

* * * * *